US007702077B2

(12) United States Patent
Cao et al.

(10) Patent No.: US 7,702,077 B2
(45) Date of Patent: Apr. 20, 2010

(54) APPARATUS FOR A COMPACT HV INSULATOR FOR X-RAY AND VACUUM TUBE AND METHOD OF ASSEMBLING SAME

(75) Inventors: Yang Cao, Niskayuna, NY (US); Louis Paul Inzinna, Scotia, NY (US); Richard Michael Roffers, Menomonee Falls, WI (US); Daniel Qi Tan, Rexford, NY (US); Mark E. Vermilyea, Niskayuna, NY (US); Yun Zou, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/122,832

(22) Filed: May 19, 2008

(65) Prior Publication Data

US 2009/0285360 A1 Nov. 19, 2009

(51) Int. Cl.
*H01J 35/06* (2006.01)
*H01J 35/00* (2006.01)

(52) U.S. Cl. ..... 378/142; 378/121

(58) Field of Classification Search ..... 378/119, 378/121, 136, 141, 142, 203; 313/27, 238–292, 313/326–340

See application file for complete search history.

(56) References Cited

U.S. PATENT DOCUMENTS

| | | | | | |
|---|---|---|---|---|---|
| 2,291,948 | A | * | 8/1942 | Cassen | 378/138 |
| 2,559,526 | A | | 7/1951 | Van de Graaff et al. | |
| 3,517,195 | A | * | 6/1970 | Leavitt | 378/124 |
| 3,626,231 | A | | 12/1971 | Kahl | |
| 3,737,698 | A | | 6/1973 | Carter | |
| 3,911,306 | A | * | 10/1975 | Peter | 378/139 |
| 4,405,876 | A | | 9/1983 | Iversen | |
| 4,618,977 | A | * | 10/1986 | Brettschneider et al. | 378/139 |
| 4,679,219 | A | * | 7/1987 | Ozaki | 378/121 |
| 5,056,126 | A | | 10/1991 | Klostermann et al. | |
| 5,122,332 | A | | 6/1992 | Russell | |
| 5,268,955 | A | | 12/1993 | Burke et al. | |
| 5,402,464 | A | * | 3/1995 | Schenk et al. | 378/136 |
| 5,689,542 | A | * | 11/1997 | Lavering et al. | 378/142 |
| 6,331,194 | B1 | | 12/2001 | Sampayan et al. | |
| 6,351,520 | B1 | * | 2/2002 | Inazaru | 378/138 |
| 6,798,865 | B2 | * | 9/2004 | Tang | 378/119 |
| 6,819,741 | B2 | * | 11/2004 | Chidester | 378/136 |
| 7,218,707 | B2 | * | 5/2007 | Holm | 378/121 |
| 2006/0185889 | A1 | | 8/2006 | Negle | |
| 2007/0058782 | A1 | * | 3/2007 | Okada et al. | 378/138 |
| 2007/0274453 | A1 | | 11/2007 | Dittrich et al. | |

OTHER PUBLICATIONS

"Center for Micro- and Nanotechnologies Annual Report 2004"; Technical University of Ilmenau; 2004; pp. 1-132.
"Surface and Material Technologies Information Brochure"; European Organization for Nuclear Research; 2000; pp. 1-28.

* cited by examiner

*Primary Examiner*—Irakli Kiknadze
*Assistant Examiner*—Anastasia Midkiff
(74) *Attorney, Agent, or Firm*—Scott J. Asmus

(57) ABSTRACT

A modular insulator assembly for an x-ray tube includes an annular insulator having a cylindrical perimeter wall, the insulator constructed of an electrically insulative material. A wall member is fixedly attached to and extending beyond the cylindrical perimeter wall, and a first shield positioned adjacent to the wall member and having an end extending proximate a corner formed by the wall member and the insulator.

19 Claims, 8 Drawing Sheets

APPARATUS FOR A COMPACT HV INSULATOR FOR X-RAY AND VACUUM TUBE AND METHOD OF ASSEMBLING SAME

BACKGROUND OF THE INVENTION

The invention relates generally to x-ray tubes and, more particularly, to an apparatus and method of fabricating a high-voltage insulator for x-ray tubes. The invention is described with respect to an x-ray system, but one skilled in the art will recognize that the invention may be used in, for instance, electron tubes or other devices in which high voltage instability occurs.

X-ray systems typically include an x-ray tube, a detector, and a gantry to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for the purpose of distributing heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, it is necessary to rotate the anode assembly at high rotational speed.

Newer generation x-ray tubes have increasing demands for providing higher peak power and higher accelerating voltages. For instance, x-ray tubes used in medical applications typically operate at 140 kV or more, while 200 kV or more is common for x-ray tubes used in security applications. However, one skilled in the art will recognize that the invention is not limited to these voltages, and applications requiring greater than 200 kV may be equally applicable. At these voltages, x-ray tubes are susceptible to high-voltage instability and insulator surface flashover which can reduce the life expectancy of the x-ray tube or interfere with the operation of the imaging system.

In a typical x-ray tube, there is a disk-shaped ceramic insulator having an opening for electrical feeds therein. The cathode post, or conduit for the electrical feeds, typically houses three or more electrical leads for feeding voltage to the cathode. Typically, the insulator, at its center opening, is attached to the cathode post which may structurally support the cathode. The cathode typically includes one or more tungsten filaments. At its perimeter, the insulator is typically hermetically connected to a cylindrical frame, which houses a vacuum chamber in which the anode and the cathode are typically positioned. In a monopolar design, voltage may be applied solely to the cathode, or to the anode. By contrast, in a bipolar design, the voltage may be applied to both the anode and cathode.

In either case, areas of the x-ray tube susceptible to failure due to high-voltage stresses include the junctions between the insulator and center cathode support structure, and between the insulator and cylindrical frame. These areas are common sources of the high-voltage instability that can reduce the life expectancy of the x-ray tube and interfere with operation of an imaging system.

The electron beam in the vacuum gap of the x-ray tube creates an electric field therein. There is the potential for insulator surface flashover in an x-ray tube when the intensity of the electric field at the insulator surface causes electrical arcing along the insulator surface between, for example, the cathode post and the cylindrical frame. The intensity of the electric field along the insulator surface, and similarly the likelihood of surface flashover, is highest when electric field force lines are perpendicular to the insulator surface.

In addition to their high-voltage operation, x-ray tubes typically operate at high temperature, which can add to the electrical stresses on x-ray tube insulators. Furthermore, the peak voltages and temperatures to which these components are subjected are likely to increase in future x-ray tube designs. Thermal stresses on x-ray tube components play a role in reducing the life expectancy of the x-ray tube as well. In some advanced applications, x-ray tubes may employ external cooling systems to cool critical components (e.g. the anode). Such advanced applications would benefit from an insulator that enables the flow of coolant to thermally stressed components in the x-ray tube.

Computed tomography (CT) systems represent an advanced application of x-ray tube technology. Some newer generation CT systems rotate the CT gantry, which includes the x-ray tube, about the patient at three revolutions per second or more. Such operation subjects the x-ray tube components to accelerations of 20 g or more, and future applications may exceed 60 g. Additionally, the newer generation CT systems seek to improve performance while decreasing the size and weight of the x-ray tubes. By reducing the size and weight of the devices that are attached to the CT gantry, the mechanical stresses on the gantry and its components are thereby reduced.

Furthermore, future x-ray tube applications may include an increased number of electrical feeds to the cathode to provide additional functionality at the cathode, such as in deflected beam applications.

Therefore, it would be desirable to have an apparatus and method to fabricate an insulator for x-ray or electron tubes that is resistant to high-voltage instability and insulator surface flashover, compact for advanced applications, and modular in design to allow for ease of repair and passage of additional electrical feeds and coolant therein.

BRIEF DESCRIPTION OF THE INVENTION

The invention provides an apparatus and method for assembling a compact insulator having improved voltage stability.

According to one aspect of the invention, a modular insulator assembly for an x-ray tube includes an annular insulator having a cylindrical perimeter wall, the insulator constructed of an electrically insulative material. A wall member is fixedly attached to and extending beyond the cylindrical perimeter wall, and a first shield positioned adjacent to the wall member and having an end extending proximate a corner formed by the wall member and the insulator.

In accordance with another aspect of the invention, a method of fabricating an x-ray tube includes providing an x-ray-tube frame configured to enclose a vacuum region, and providing an electrical insulator having a perimeter wall. The method further includes attaching a wall member to the perimeter wall, the wall member having a surface exposed to the vacuum region, wherein a confluence of the insulator, the wall surface and the vacuum region form a junction, and positioning one end of a first shield proximately to the junction.

Yet another aspect of the invention includes an imaging system having an x-ray detector and an x-ray tube. The x-ray tube includes an annular insulator having an outer perimeter wall and an inner perimeter wall, a cylindrical wall member attached to the outer perimeter wall, the wall member having a center axis and configured to encircle a vacuum region about the center axis, and wherein a confluence of the insulator, the wall member, and the vacuum region form a first junction, and a first shield having a conical portion and a toroidal portion, wherein a base of the conical portion is attached to the wall member, and wherein the toroidal portion is positioned in the vacuum region between the wall member and the center axis.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
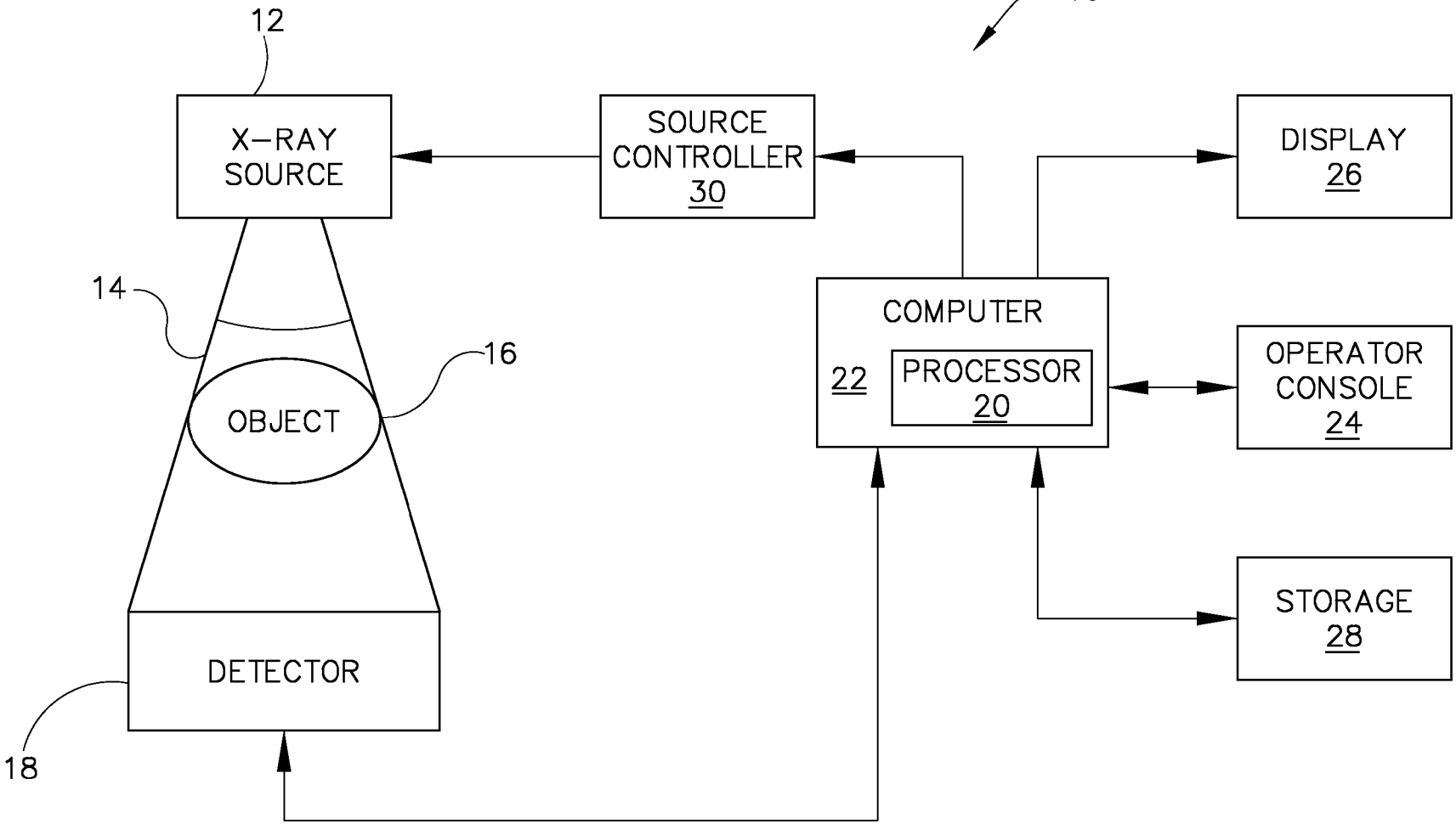
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous medical or industrial imaging systems utilizing an x-ray tube, such as projection x-ray or mammography systems. Other imaging systems such as computed tomography systems and digital radiography systems, which acquire image three dimensional data for a volume, also benefit from the invention. The following discussion of projection x-ray system 10 is merely an example of one such implementation and is not intended to be limiting in terms of modality.

As shown in FIG. 1, x-ray system 10 includes an x-ray tube or source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 kV to 200 kV. The x-rays 14 pass through object 16 and, after being attenuated by the object 16, impinge upon a detector 18. Each cell in detector 18 produces an analog electrical signal that represents the intensity of an impinging x-ray beam, and hence the attenuated beam, after it passes through the object 16. In one embodiment, detector 18 is a scintillation-based detector, however, it is envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Moreover, the invention will be described with respect to use in an x-ray tube. However, one skilled in the art will further appreciate that the invention is equally applicable for other systems (e.g., electron tubes) that require the installation of an electrical insulator that operates under high voltage, having a propensity to experience surface flashover or voltage instability.

Figure 2:
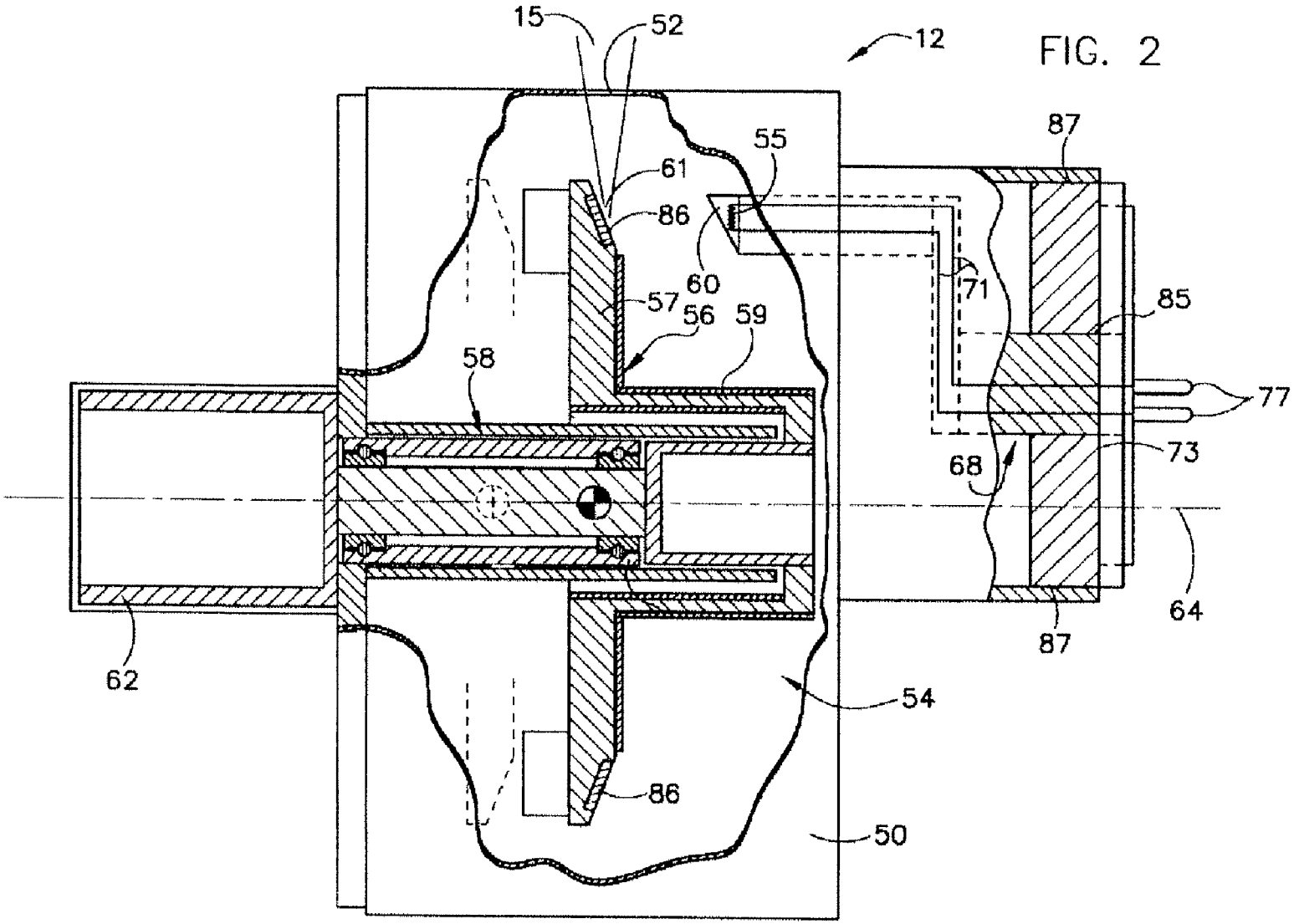
FIG. 2 a cross-sectional view of an x-ray tube according to an embodiment of the invention and useable with the system illustrated in FIG. 1.

FIG. 2 illustrates a cross-sectional view of an x-ray tube 12 incorporating an embodiment of the invention. The x-ray tube 12 includes a frame 50 having a radiation emission passage 52 formed therein. The frame 50 surrounds an enclosure, or vacuum region 54, and houses an anode 56, a bearing cartridge 58, a cathode 60, and a rotor 62. The anode 56 includes a target 57 having a target material 86, and having a target shaft 59 attached thereto.

The cathode 60 typically includes one or more filaments 55. The cathode filaments 55 are powered by electrical leads 71 that pass through a center post 68 in the vacuum region 54. In addition to electrical leads 71, the center post 68, in an embodiment of the invention, contains coolant lines 185 (in FIG. 4) through which coolant may be supplied to the anode 56. The center post 68 is typically positioned at the center of, and attached to, an insulator 73. The electrical leads 71 connect to electrical contacts 77 on the exterior of the x-ray tube 12. The insulator 73 is typically fabricated of alumina or other ceramic materials such as steatite or aluminum nitride.

In operation, an electric current is applied to the desired filament 55 via electrical contacts 77 to heat the filament so that electrons may be emitted from filament 55. A high-voltage electric potential is applied between the anode 56 and the cathode 60, and the difference therebetween results in an electron beam, or electrical current, flowing through the vacuum region 54 from cathode 60 to anode 56. The voltage difference between the anode 56 and the cathode 60 can be maintained using either a monopolar or a bipolar x-ray tube design. For monopolar, the voltage is applied to either the anode 56 or the cathode 60. For bipolar, the voltage is applied to both anode 56 and cathode 60. Depending on the design, high-voltage insulation may be needed at either the anode 56, the cathode 60, or at both locations 56, 60.

The electrons impact the target track material 86 at focal point 61 and x-rays 15 emit therefrom. The x-rays 15 emit through the radiation emission passage 52 toward a detector array, such as detector 18 of FIG. 1. As electrons impact focal point 61 and produce x-rays 15, heat generated therein causes the target 57 to increase in temperature, thus causing the heat to transfer via radiation heat transfer to surrounding components such as the frame 50. To avoid overheating the target track material 86 by the electrons, the anode 56 is rotated at a high rate of speed about a centerline 64 at, for example, 90-250 Hz.

Though the embodiments disclosed show an insulator 73 assembled to the cathode 60 side of the x-ray tube 12, one skilled in the art will be able to envision embodiments in which the anode 56 is at some electric potential, thereby requiring an insulator 73 to be assembled to the anode 56 side of the x-ray tube 12.

Figure 3:
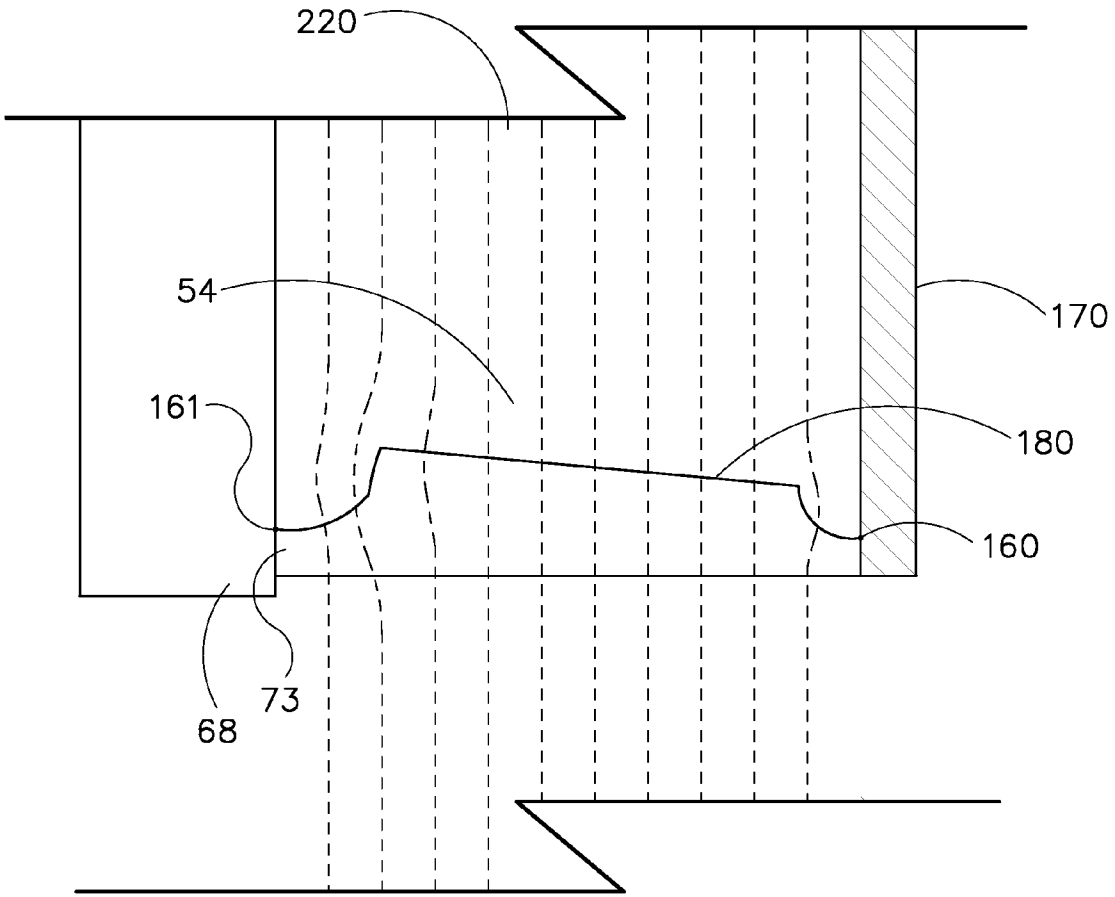
FIG. 3 PRIOR ART
FIG. 3 is a cross-sectional view showing the electric field force lines in an x-ray tube including a compact insulator but no shield components.

During operation of the x-ray tube 12, an electric field is generated within the vacuum region 54 of x-ray tube 12 by the electrical potential between cathode 60 and anode 56. As shown in FIG. 3, this electric field is represented by the electric field force lines 220. The electric field has a certain intensity at a surface 180 of insulator 73, and the electric field intensity at the insulator surface 180 is enhanced at two triple-point junctions 160, 161. The electric field induces a polarization charge on the insulator surface 180. As such, if the polarization charge on the insulator surface 180 is greater than a threshold, the insulator surface 180 becomes conductive, which is a condition known as dielectric breakdown, and can result in insulator surface flashover, which is characterized by electrical arcing along the surface 180. The polarization charge and the likelihood of dielectric breakdown are increased when the electric field force lines 220 are essentially perpendicular to the insulator surface 180 as shown in FIG. 3. The approximately 90-degree intersection of field force lines 220 and insulator surface 180 represents a worst-case scenario in terms of the force lines 220 contribution to insulator surface flashover.

Another factor in the initiation of insulator surface flashover typically includes electrons being emitted from the triple-point junctions 160, 161. These electrons gain kinetic energy from the electric field at the insulator surface 180 and cause the electrons to cascade along the insulator surface 180. Electrons with high kinetic energy may strike the insulator surface 180 and produce more electrons through secondary electron emission avalanche. Continuation of this process may lead to electrical breakdown of the insulator 73 at the surface 180.

As explained above, the electric field in the vacuum region 54 is enhanced at the triple-point junctions 160, 161. Such enhancement can lead to electrical-stress-induced failure of the insulator 73 at the triple-point junctions 160, 161, and to voltage instability due to insulator surface flashover during operation of the x-ray tube 12. The likelihood of surface flashover may be reduced, according to embodiments of the invention, by reducing the electron emission at the triple-point junction and by reducing the tangential electric field along the insulator surface 180 such that the field-emitted electrons from the triple-point junction 160, 161 do not gain enough kinetic energy to initiate insulator surface flashover.

Figure 4:
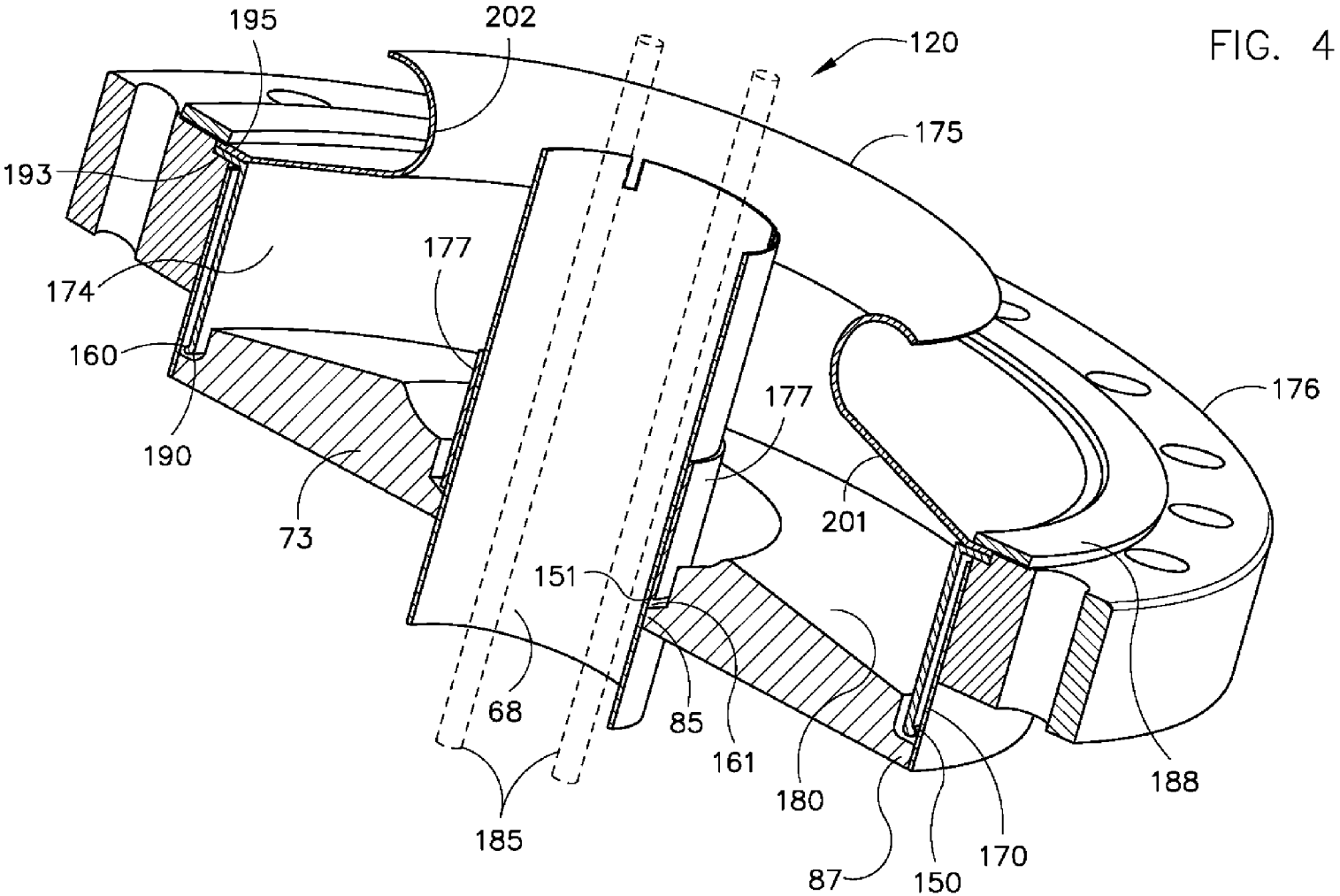
FIG. 4 is an illustration of a compact insulator according to an embodiment of the invention and useable with the x-ray tube illustrated in FIG. 2.
Figure 5:
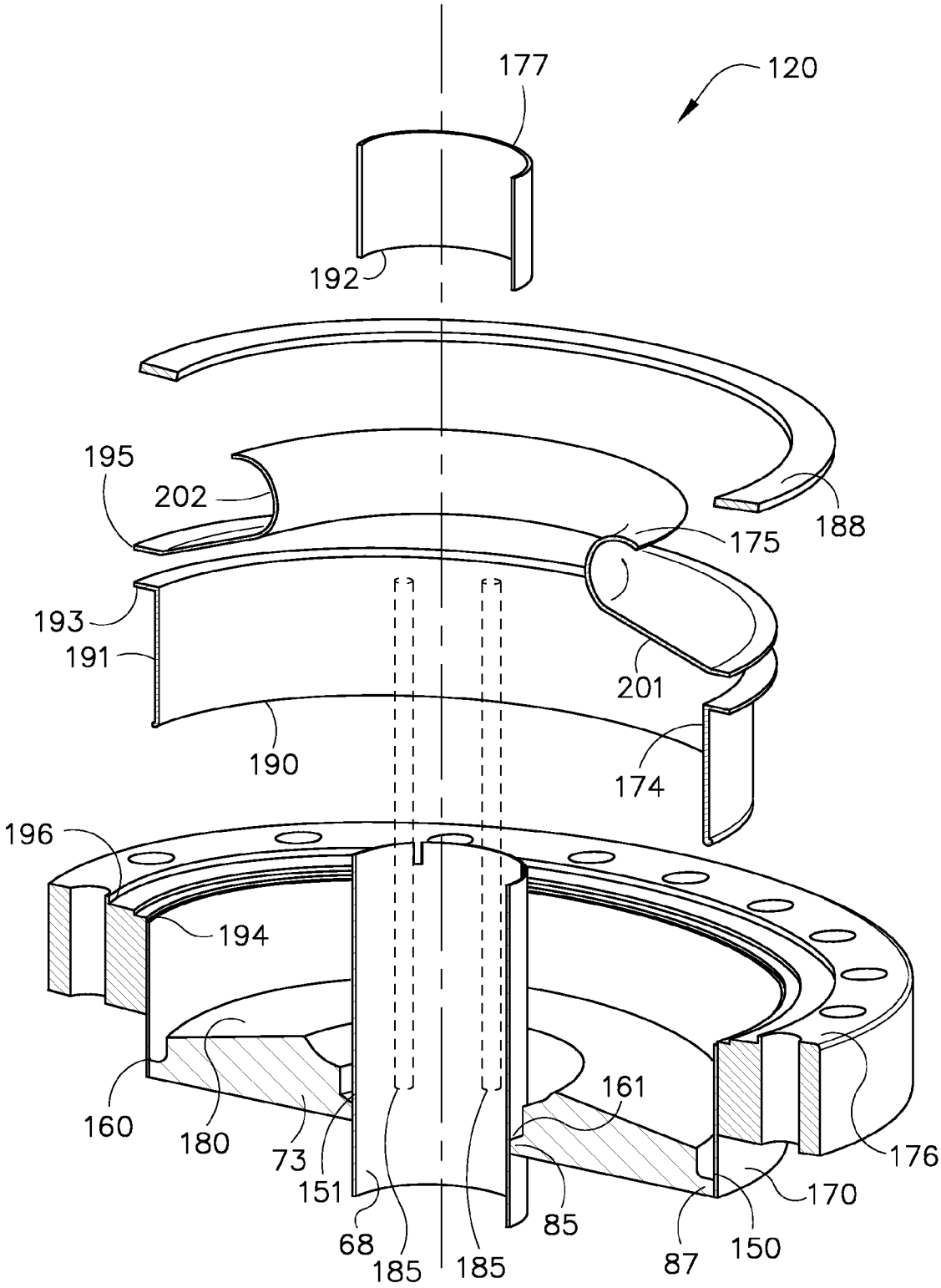
FIG. 5 is an illustration of an exploded view of a compact insulator according to an embodiment of the invention and useable with the x-ray tube illustrated in FIG. 2.

Accordingly, FIGS. 4 and 5 illustrate an insulator subassembly 120 that may be used in the x-ray tube 12 of FIG. 2 according to an embodiment of the invention for the reduction of both the electron emission at the triple-point junction and the tangential electric field along the insulator surface. Insulator 73 has an outer perimeter wall 87 and an inner perimeter wall 85. The insulator 73 is attached to a center post 68, which is typically a conductive metal, at inner perimeter wall 85 and to a wall member 170, which may be part of a flange 176, at outer perimeter wall 87. The flange 176, including the wall member 170, is typically made of a metal such as stainless steel or Kovar. When attached to the x-ray tube 12 of FIG. 2 and exposed to the vacuum region 54 within x-ray tube 12, a junction of the wall member 170 and ceramic insulator 73 form a first triple-point junction 160. A junction of the center post 68 and the ceramic insulator 73 form a second triple-point junction 161 in the vacuum region 54.

A shield 174, having a lip 193 and a cylindrical section 191, is attached to a flange 176. The flange 176 has a small stepped portion 194 machined out of the flange surface. The lip 193 of shield 174 fits into the stepped portion 194 during assembly which serves to electrically couple the shield 174 to the flange 176. When the metal flange 176 is attached to the metal x-ray tube frame 50, the shield 174, flange 176, and frame 50 are all electrically coupled. In embodiments where the cathode 60 is at potential, the x-ray tube frame 50 is typically grounded, in which case the shield 174 is grounded also. The cylindrical section 191 of shield 174 extends along the wall member 170. A roughly U-shaped cavity or groove 215 is formed in insulator 73 near outer perimeter wall 87 such that cavity 215 is formed between the wall member 170 and the insulator 73. Shield 174 has an end 190 that is preferably positioned so that end 190 extends into the cavity 215 and proximate to the triple-point junction 160, thus reducing the electric field intensity at the triple-point junction 160 and improving the high-voltage stability of the x-ray tube 12. As a result, electrical stresses on the insulator 73 at the triple-point junction 160 are also reduced.

As shown in FIGS. 4 and 5, a second shield 175, having a circular base or lip 195, a conical section 201, and a toroidal section 202, is attached to wall member 170 of flange 176. From the base 195, the conical portion 201 of shield 175 tapers toward an apex (not shown). Before reaching the apex, shield 175 curves outward to form toroid section 202. The toroidal portion 202 of shield 175 is positioned in vacuum region 54 between the center of x-ray tube 12 and wall member 170.

The flange 176 has a small stepped portion 194 machined out of the flange surface. The lip 195 of shield 175 fits into the stepped portion 194 of flange 176 over the lip 193 of shield 174. A gasket 188, typically made of a malleable metal such as copper, is used to attach shields 174, 175 to flange 176. The gasket 188 fits over the lips 193, 195 of the two shields 174, 175 and into a second stepped portion 196 machined out of the surface of the flange 176. Assembly in this manner serves to electrically couple the second shield 175 to shield 174, to flange 176, and to the x-ray tube frame 50. Both shield components 174, 175 are made of an electrically conductive material. In preferred embodiments, shields 174, 175 are made of metals that can accept a high polish such as stainless steel, Kovar, Invar, or oxygen-free high-purity copper.

Referring still to FIGS. 4 and 5, a shield 177 having an end 192 may be attached to the center post 68 such that end 192 is positioned proximate to the triple-point junction 161 according to embodiments of the invention. Assembly of shield 177 includes electrically coupling shield 177 to center post 68. In embodiments where the cathode 60 is at potential, the center post 68 and shield 177 are at the same potential as the cathode 60. A roughly U-shaped cavity or groove 210 may be formed in insulator 73 near inner perimeter wall 85 such that cavity 210 is formed between the center post 68 and the insulator 73. End 192 of shield 177 is preferably positioned to extend into the cavity 210. Positioning the shield 177 proximate the triple-point junction 161 reduces the electric field intensity at triple-point junction 161, thus improving the high-voltage stability of the x-ray tube 12. As a result of this positioning, the electrical stresses on the insulator 73 at the triple-point junction 161 are also reduced.

Typically, an embodiment, wherein the cathode 60 is at potential, will have shield 177 at the center post 68 to protect the triple-point junction 161. An embodiment, wherein anode 56 is at potential, will generally have shield 174 at outer wall member 170 to protect the triple-point junction 160. However, it is contemplated that insulator assembly 120 may include one or both of shields 177, 174 to improve the high-voltage stability of x-ray tube 12.

Figure 6:
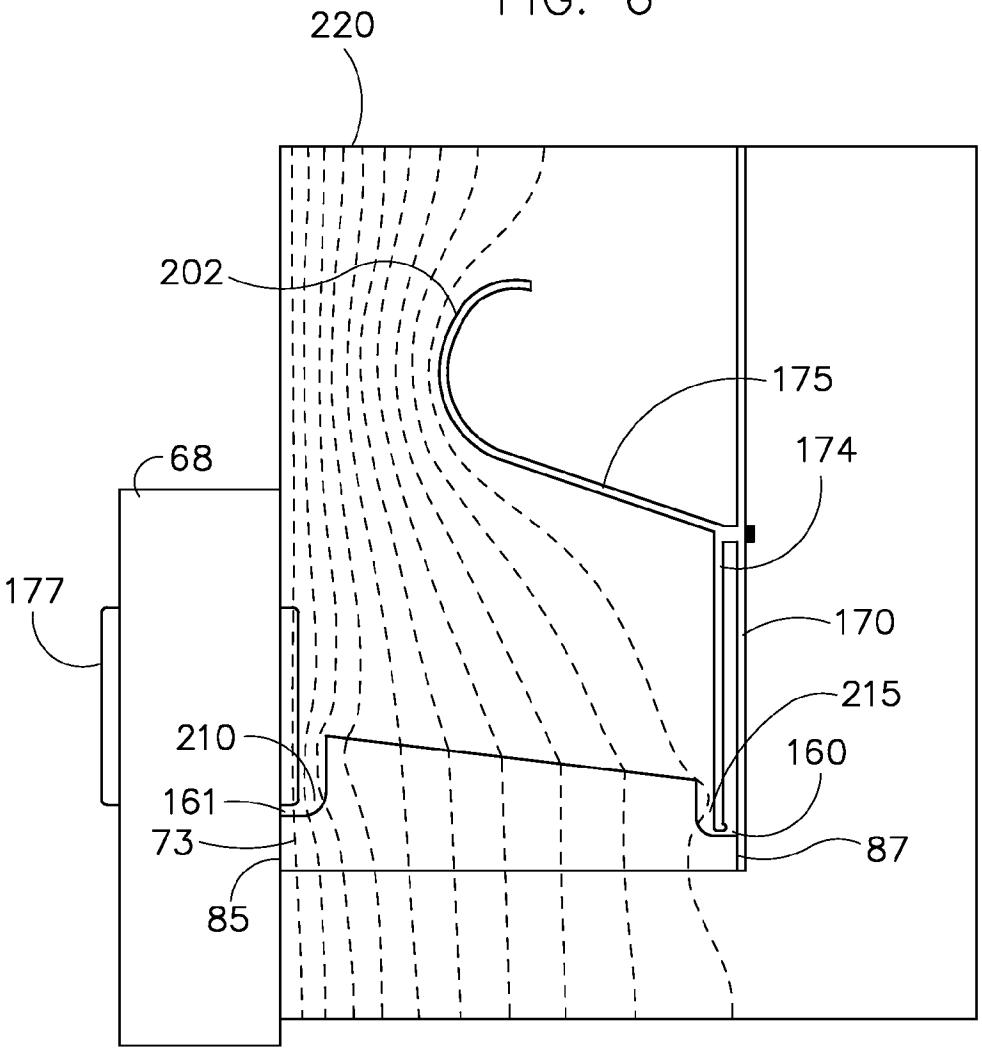
FIG. 6 is a cross-sectional view showing the electric field force lines in an x-ray tube including a compact insulator and both first and second shield components.

Shields 177 and 174 serve to reduce electron emission at the triple point junctions 160, 161, while shield 175 serves to reduce the tangential electric field at the insulator surface 180 by causing compression of the electric field in the vacuum region 54 to change the direction of the electric field force lines 220 such that the force lines are less perpendicular with respect to the insulator surface 180. The curve of the toroidal portion 202 compresses the electrical field lines 220 at the toroidal portion 202. Because the separation between the field lines 220 increase with distance from the toroidal portion 202, electrical field lines 220 are caused to impinge insulator surface 180 more and more acutely, as illustrated by FIG. 6. Electric field lines 220 that intersect insulator surface 180 at an acute angle generate a smaller tangential electric field than field lines 220 intersecting an insulator surface at right angles, thereby reducing the potential for dielectric breakdown and insulator surface flashover.

Referring again to FIG. 5, a ceramic coating 150 is applied to the wall member 170 at the triple-point junction 160 around the outer perimeter 87 of the insulator 73, and a second ceramic coating 151 is applied to the center post 68 at the triple-point junction 161. Ceramic coatings 150, 151 are applied around the circumference of wall member 170 and center post 68, respectively, from the triple-points 160, 161 and extend up along the surfaces of wall member 170 and center post 68. In an embodiment of the invention, coatings 150, 151 extend for, preferably, two millimeters or more from triple-points 160, 161. Accordingly, shields 177, 174 are also preferably vertically positioned to within two millimeters of the triple-point junctions 160, 161.

Figure 7:
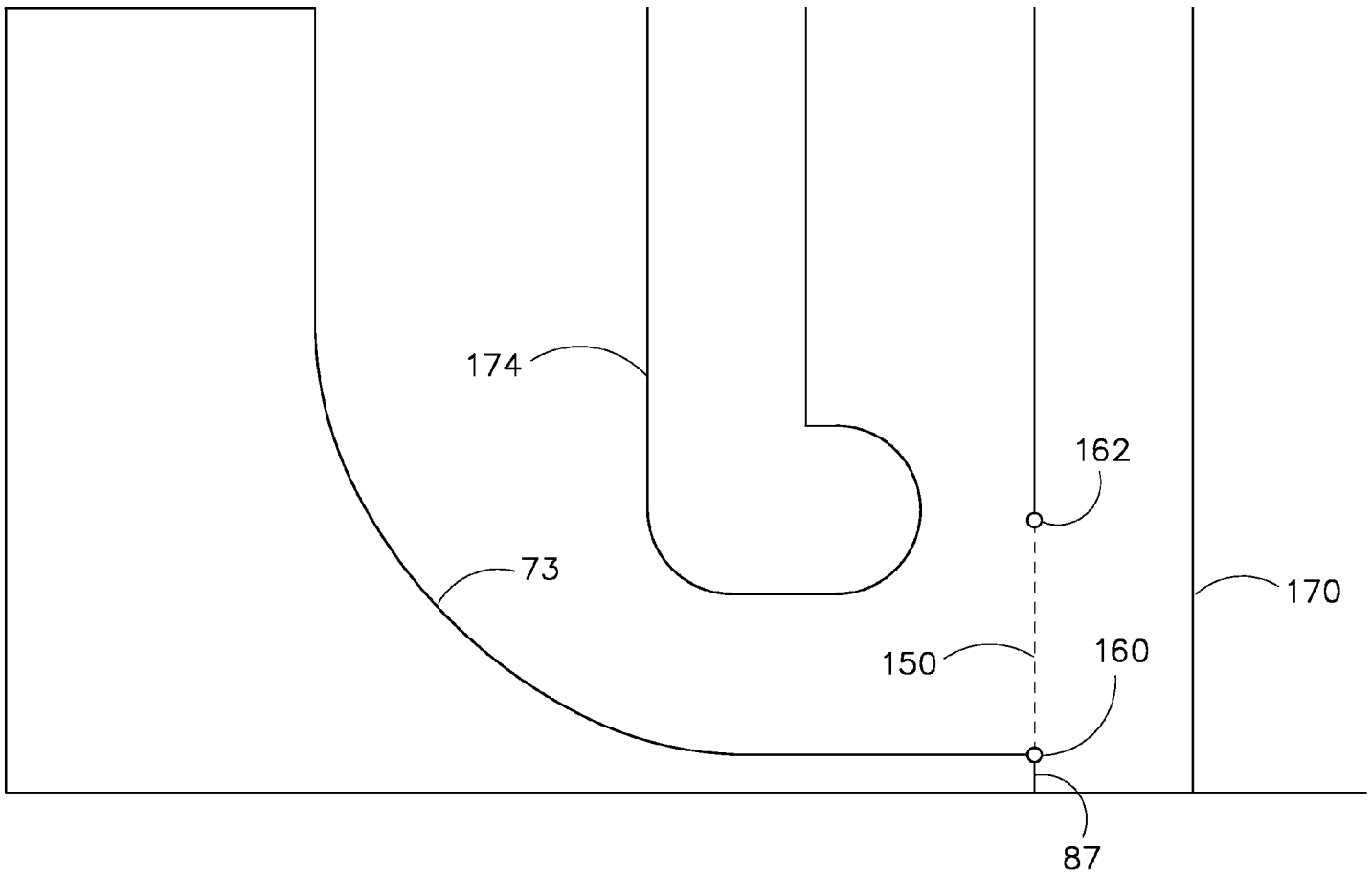
FIG. 7 is a cross-sectional close-up view showing the shield in proximity to the compact insulator and ceramic coating at the triple-point junction.

FIG. 7 shows a cross-section of a portion of insulator assembly 120 about triple-point junction 160. As shown, the ceramic coating 150 functions to reduce the intensity of the electric field at the junction of insulator 73 and wall member 170 by changing the location of the metal-dielectric-vacuum junction from the junction of insulator 73 and wall member 170 to location 162. The new triple-point junction 162 is located behind the shield 174 to reduce the amount of electron emission from the triple-point junction 162, thereby reducing the cascading effect and likelihood of insulator surface flashover. While the embodiment shown in FIG. 7 is directed toward coating 150, one skilled in the art will appreciate that coating 151 and its effect may be similarly shown with regard to center post 68 and shield 177.

Ceramic coatings 150, 151 include simple oxides, such as aluminum oxide and zirconium dioxide, ferroelectric thin films, such as barium titanate, glasses, thermal barrier coatings, and dielectric layers, such as tantalum pentoxide and silicon oxynitride. Ceramic coatings 150, 151 can be applied by various techniques including dip coating, dielectric paste printing, aerosol spraying, plasma spraying, and water-based ceramic paste brushing. Applied coatings generally require drying or curing at temperatures form 100° C. to 600° C. depending on the curing process used.

The combination of two shield components 174, 175 (shown in FIGS. 4 and 5) and ceramic coating 150 make the fabrication of a more compact, or low-profile, insulator 73 possible. Thus, according to an embodiment of the invention, the diameter of the insulator 73 may be minimized while improving high-voltage stability. The size reduction in the insulator 73 may make the insulator 73 less costly to produce, and the x-ray tube or source more compact, thus facilitating advanced imaging applications, such as CT scanning. Currently, a typical x-ray tube insulator 73 may be eight inches in diameter. However, embodiments of the invention allow insulator diameters of approximately six inches. It is also contemplated that diameters of 3 to 4 inches may be possible.

A modular design for the insulator assembly 120 may enable some components to be shared between insulator assemblies made for the anode 56, and those made for the cathode 60, while other components may have to be specifically adapted for use at either the anode 56 or cathode 60. This flexibility, which allows use of the same component in different areas of the x-ray tube 12, can make the modular design a more cost-effective method of fabricating insulator assemblies. Also, repairs are more easily and inexpensively performed with a modular design in that, damage to any one part of the insulator assembly may require replacement of only the damaged component while leaving the undamaged portions of the insulator assembly unaffected.

Figure 8:
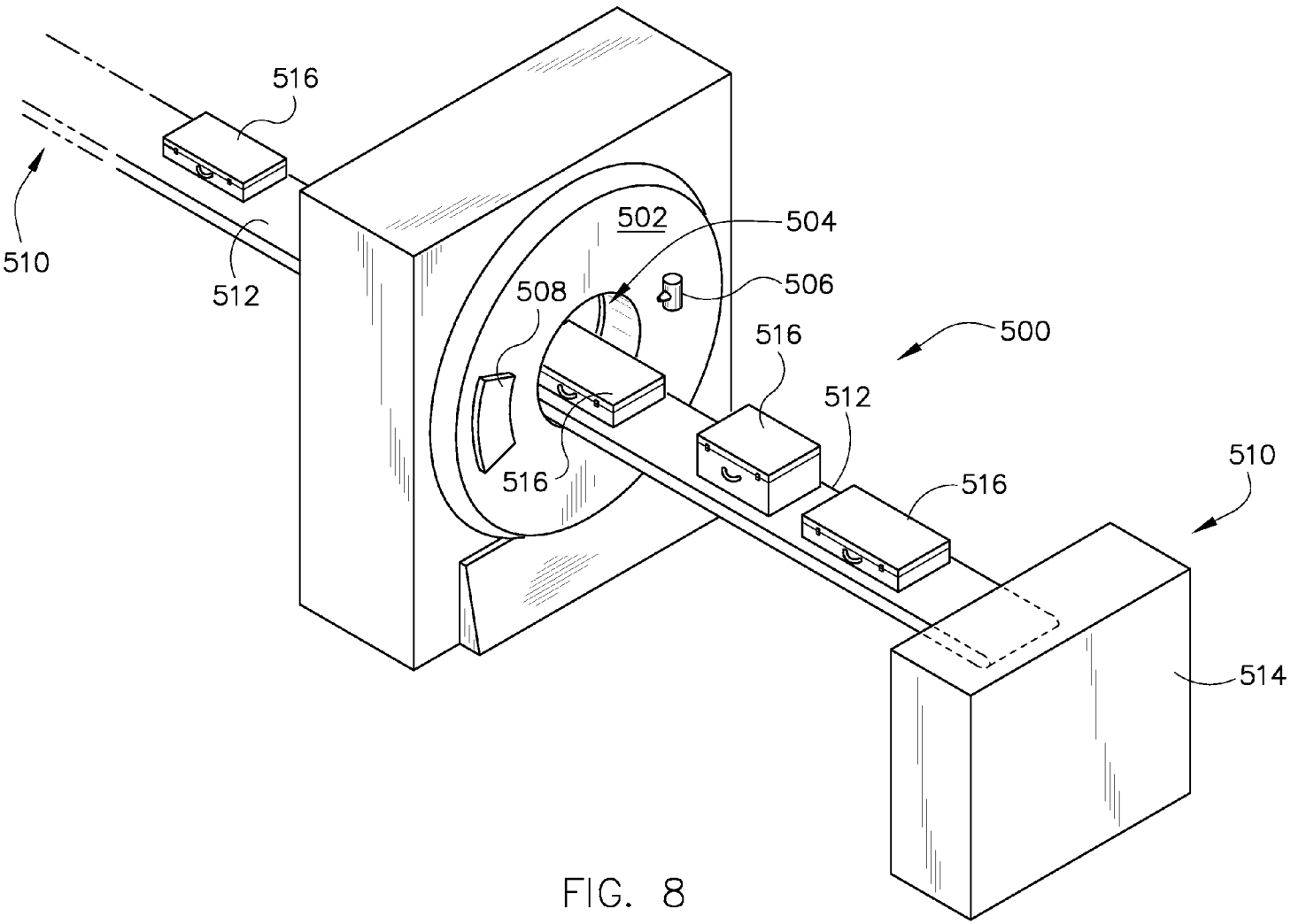
FIG. 8 is a pictorial view of a CT system for use with a non-invasive package inspection system.

FIG. 8 is a pictorial view of a CT system for use with a non-invasive package inspection system. Package/baggage inspection system 500 includes a rotatable gantry 502 having an opening 504 therein through which packages or pieces of baggage may pass. The rotatable gantry 502 houses a high frequency electromagnetic energy source 506 as well as a detector assembly 508 having scintillator arrays comprised of scintillator cells. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512. Imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc.

While electron tube design may include various structural incarnations, the underlying principles of operation are essentially the same such that one skilled in the art will understand that the scope of the invention includes application to electron tubes generally as well as the x-ray tubes described herein.

According to one embodiment of the invention, a modular insulator assembly for an x-ray tube includes an annular insulator having a cylindrical perimeter wall, the insulator constructed of an electrically insulative material. A wall member is fixedly attached to and extending beyond the cylindrical perimeter wall, and a first shield positioned adjacent to the wall member and having an end extending proximate a corner formed by the wall member and the insulator.

In accordance with another embodiment of the invention, a method of fabricating an x-ray tube includes providing an x-ray-tube frame configured to enclose a vacuum region, and providing an electrical insulator having a perimeter wall. The method further includes attaching a wall member to the perimeter wall, the wall member having a surface exposed to the vacuum region, wherein a confluence of the insulator, the wall surface and the vacuum region form a junction, and positioning one end of a first shield proximately to the junction.

Yet another embodiment of the invention includes an imaging system having an x-ray detector and an x-ray tube. The x-ray tube includes an annular insulator having an outer perimeter wall and an inner perimeter wall, a cylindrical wall member attached to the outer perimeter wall, the wall member having a center axis and configured to encircle a vacuum region about the center axis, and wherein a confluence of the insulator, the wall member, and the vacuum region form a first junction, and a first shield having a conical portion and a toroidal portion, wherein a base of the conical portion is attached to the wall member, and wherein the toroidal portion is positioned in the vacuum region between the wall member and the center axis.

The invention has been described in terms of the preferred embodiment, and it is recognized that equivalents, alternatives, and modifications, aside from those expressly stated, are possible and within the scope of the appending claims.

What is claimed is:

1. A modular insulator assembly for an x-ray tube comprising:

an annular insulator having a cylindrical perimeter wall, the insulator constructed of an electrically insulative material;

a wall member fixedly attached to and extending beyond the cylindrical perimeter wall; and a first shield positioned adjacent to the wall member and having an end extending proximate a corner formed by the wall member and the insulator wherein the first shield and the wall member are electrically coupled.

2. The modular insulator assembly of claim 1 wherein the wall member is one of an x-ray-tube frame and an x-ray tube flange wall, and the cylindrical perimeter wall is an outer perimeter wall of the annular insulator, wherein the wall member is attached to the outer perimeter wall.

3. The modular insulator assembly of claim 2 wherein the wall member is a cylindrical wall member having a center axis, and wherein the modular insulator assembly further comprises a second shield having a conical portion and a toroidal portion, wherein a base of the conical portion is attached to the wall member, and wherein the toroidal portion is positioned closer to the center axis than the conical portion and the second shield is electrically coupled to the first shield.

4. The modular insulator assembly of claim 1 further comprising a center post comprising the wall member, the center post supporting a cathode the cylindrical perimeter wall comprises an inner perimeter wall of the annular insulator, and wherein the central post is attached to an inner perimeter wall.

5. The modular insulator assembly of claim 1 wherein the annular insulator has a cavity formed therein adjacent to the cylindrical perimeter wall, wherein the end of the first shield extends into the cavity and is electrically coupled to the cylindrical perimeter wall.

6. The modular insulator assembly of claim 1 having an x-ray tube frame configured to enclose a vacuum region wherein a confluence of the wall member, the insulator, and the vacuum region form a junction, and further comprising a ceramic coating applied to the perimeter of the wall member at the junction, the ceramic coating extending along the wall member to a distance from the junction greater than the distance from the junction to the proximate end of the first shield.

7. A method of fabricating an x-ray tube comprising:

providing an x-ray-tube frame configured to enclose a vacuum region;

providing an electrical insulator having a perimeter wall;

attaching a wall member to the perimeter wall, the wall member having a surface exposed to the vacuum region, wherein a confluence of the insulator, the wall surface and the vacuum region form a junction; and positioning one end of a first shield proximate to the junction and electrically coupling the wall member and the first shield.

8. The method of claim 7 further comprising applying a ceramic coating to a portion of the surface of the wall member near the junction, wherein the ceramic coating extends along the surface of the wall member to a distance from the junction greater than the distance from the junction to the one end of the shield thereby decreasing stray electron emission.

9. The method of claim 7 wherein the wall member is an x-ray-tube flange wall, and wherein the perimeter wall is an outer perimeter wall.

10. The method of claim 9 further comprising:

providing a second shield having a conical portion and a toroidal portion; and attaching the base of the conical portion to the x-ray tube flange wall and electrically coupling the first shield and the second shield.

11. The method of claim 7 wherein attaching the wall member to the perimeter wall of the insulator comprises attaching a wall member of a center post to an inner perimeter of the insulator.

12. An imaging system comprising:

an x-ray detector; and an x-ray tube comprising:

an annular insulator having an outer perimeter wall and an inner perimeter wall;

a cylindrical wall member attached to the outer perimeter wall, the wall member having a center axis and configured to encircle a vacuum region about the center axis, and wherein a confluence of the insulator, the wall member, and the vacuum region form a first junction; and a first shield having a conical portion and a toroidal portion, wherein a base of the conical portion is attached to the wall member, wherein the toroidal portion is positioned in the vacuum region between the wall member and the center axis; and wherein the first shield and the outer perimeter wall are electrically coupled.

13. The imaging system of claim 12 wherein the cylindrical wall member is one of an x-ray-tube frame and an x-ray-tube flange wall.

14. The imaging system of claim 12 further comprising a ceramic coating applied around the perimeter of the cylindrical wall member at the first junction, the ceramic coating extending along the cylindrical wall member to a distance from the first junction greater than the distance from the first junction to the proximate end of the first shield.

15. The imaging system of claim 12 further comprising a center post having an exterior wall attached to the inner perimeter wall of the insulator, and wherein a confluence of the insulator, center post, and vacuum region form a second junction.

16. The imaging system of claim 15 further comprising a cathode, wherein the cathode is supported by the center post.

17. The imaging system of claim 15 further comprising a second shield having an end positioned proximate one of the first and second junctions and electrically coupled to the wall member.

18. The imaging system of claim 15 further comprising a ceramic coating applied around the perimeter of the center post at the second junction, the ceramic coating extending along the center post to a distance from the second junction farther than the distance from the second junction to the proximate end of the second shield.

19. The imaging system of claim 15 wherein the insulator has a first cavity adjacent to the wall member and a second cavity adjacent to the center post, wherein the end of the second shield is positioned within one of the first and second cavities, and is electrically coupled to the wall member.

* * * * *